United States Patent [19]

Barkan

[11] 4,381,435

[45] Apr. 26, 1983

[54] VACUUM CIRCUIT BREAKER WITH MEANS FOR SELECTIVELY LATCHING A WIPE CAGE

[75] Inventor: Philip Barkan, Stanford, Calif.

[73] Assignee: General Electric Company, Schenectady, N.Y.

[21] Appl. No.: 222,183

[22] Filed: Jan. 2, 1981

[51] Int. Cl.[3] ..... H01H 33/66

[52] U.S. Cl. ..... 200/144 B; 200/288

[58] Field of Search ..... 200/144 B, 288, 154; 335/167, 168, 151

[56] References Cited

U.S. PATENT DOCUMENTS

| | | | |
|---|---|---|---|
| 3,163,735 | 12/1964 | Miller | 200/144 |
| 3,180,960 | 4/1965 | Barkan et al. | 200/166 |
| 3,248,497 | 4/1966 | Lindsay | 200/144 B |
| 3,787,649 | 1/1974 | Goodwin, Jr. et al. | 200/153 LA |
| 4,064,383 | 12/1977 | Barkan | 200/144 B |
| 4,099,039 | 7/1978 | Barkan | 200/144 B |

*Primary Examiner*—A. T. Grimley
*Assistant Examiner*—Morris Ginsburg
*Attorney, Agent, or Firm*—Charles E. Bruzga; James C. Davis, Jr.; Marvin Snyder

[57] ABSTRACT

A vacuum circuit breaker having a movable contact coupled through a wipe cage to an operating member which imparts movement during opening and closing strokes to the movable contact is provided with a latch for latching the wipe cage into its fully extended position during selected portions of the opening and closing strokes.

11 Claims, 3 Drawing Figures

VACUUM CIRCUIT BREAKER WITH MEANS FOR SELECTIVELY LATCHING A WIPE CAGE

BACKGROUND OF THE INVENTION

The present invention relates to a vacuum circuit breaker having a wipe cage, and more particularly, relates to means for selectively latching the wipe cage.

The usual vacuum circuit breaker comprises a sealed, evacuated envelope containing a stationary contact and a movable contact, with the movable contact being movable from a closed position, in which it abuts the stationary contact to an open position, in which it is separated from the stationary contact. Typically an operating member imparts movement to the movable contact through a coupling member. The operating member separates the contacts during an opening stroke and causes the contacts to abut each other during a closing stroke. The two ends of the wipe means are resiliently biased apart by a spring. The wipe means includes means to limit the maximum distance of separation between the ends. With the movable contact in the closed position, the wipe means ends are separated by less than the maximum distance of separation, whereby latitude in the separation between the movable contact (connected to a first wipe means end) and the operating member (connected to a second wipe means end), or contact wipe, is provided by the wipe means. Such contact wipe accommodates contact wear, provides a predetermined force (that is, the force of the spring) between the contacts when the movable contact is in the closed position, and, before the movable contact travels from the closed position to the open position, the operating member is allowed to build up speed before the wipe means ends are separated to the maximum extent whereby the movable contact is forced to separate abruptly from the stationary contact.

To maintain the interior of the envelope under vacuum, a bellows is typically provided between the coupling member and the envelope. The bellows typically comprises a plurality of folds or convolutions each formed from sheet stainless steel with a typical thickness of three thousandths of an inch. The bellows, thus, is likely to be rather delicate.

Problems can arise during the opening stroke of the operating member if the wipe means spring is subject to contraction owing to severe deceleration of the operating member, which can arise near the end of the opening stroke thereof. If the wipe means spring becomes so contracted, the movable contact, and consequently the bellows, will be subject to "overtravel" or travel beyond that which is necessary for the movable contact to be moved into an open position. Such overtravel subjects the bellows to exacerbated deformation, and is particularly deleterious to the bellows if the convolutions thereof are caused to press againt each other. Additionally, such overtravel is followed by the movable contact rebounding at high speed away from the operating member. Inasmuch as one end of the bellows moves with the movable contact, there will be imposed on the bellows a range of deformation of individual convolutions thereof, or stress, typically, approximately three times the range of deformation of individual convolutions, or stress, imposed on the bellows in the absence of overtravel and high speed rebound. This fact has not been clearly understood before the present invention. Further, in the event that overtravel of the movable contact is extensive enough as to cause the wipe means spring to become fully contracted, the movable contact will impact against the operating member. The consequent motion of the bellows (one end of which moves with the bellows) will produce a particularly high stress therein.

A problem may arise during the closing stroke of the operating member, if, during this time, the wipe means spring has first contracted, owing to severe acceleration of the operating member which can arise near the beginning of the closing stroke thereof, and is then in the process of expanding when the movable contact comes into abutment with the stationary contact. Under these conditions, the velocity of the movable contact, just prior to coming into abutment with the stationary contact, is subject to an increase in value due to the expanding of the wipe means spring. Accordingly, in addition to a large stress generated in the bellows, the movable contact could strike the stationary contact and rebound away from the stationary contact one or more times, until finally coming to rest against the stationary contact. During each rebound, the possibility of severe erosion and welding of the contacts is present.

A known vacuum circuit breaker including the above features further includes a stop which limits the extent to which the wipe means spring can contract, and thus, the maximum attainable contact wipe, to a value such as three-sixteenths inch. The provision of such a stop is useful for limiting overtravel of the movable contact, and thus, the bellows, during the opening stroke of the operating member: however, the remaining overtravel of the movable contact and the bellows is still excessive. Additionally, the high speed rebound of the movable contact and the bellows following overtravel, remains excessive, notwithstanding the provision of the stop. Further, during the closing stroke of the operating member, the problem of the movable contact impacting the stationary contact and rebounding therefrom, with the risk of severe erosion and welding of the contacts, remains substantially unaffected by the provision of the stop.

OBJECTS OF THE INVENTION

Accordingly, it is an object of the present invention to provide means for substantially eliminating contraction of the spring of a wipe means and the accompanying overtravel and high speed rebounding of the movable contact and the bellows of a vacuum circuit breaker incorporating the wipe means during an opening stroke.

A further object of the present invention is to provide means for substantially reducing rebounding of the movable contact from the stationary contact of a vacuum circuit breaker having a wipe means, which rebounding can occur near the end of the closing stroke.

Further objects and advantages of the present invention will become apparent from a reading of the remainder of this specification in conjunction with the drawing figures.

SUMMARY OF THE INVENTION

In accomplishing the objects of the present invention in one form, there is provided a vacuum circuit breaker having a sealed, evacuated envelope containing first and second separable electrical contacts. The first contact is movable with respect to the second contact, from a closed position when abutting the second contact and carrying normal current to a fully open position when separated from the second contact and not carrying current. The movable contact is coupled to the first end of a wipe cage or means having two ends by a coupling member which extends into the envelope. A bellows means provides a gas-tight seal between the coupling member and the envelope. The wipe means comprises means for resiliently biasing apart the ends, and means to limit the maximum distance of separation between the ends, and provides contact wipe when the first contact is in the closed position. An operating member is coupled to the second end of the wipe means for separating the contacts during an opening stroke and for moving the contacts into engagement during a closing stroke. A latch means, which becomes actuated during the opening stroke of the operating member, is provided for fixedly biasing apart the ends of the wipe means to substantially the maximum distance of separation. Additionally, a latch disabling means, becoming actuated during the closing stroke of the operating member, is provided for disabling the latch means.

Figure 1:
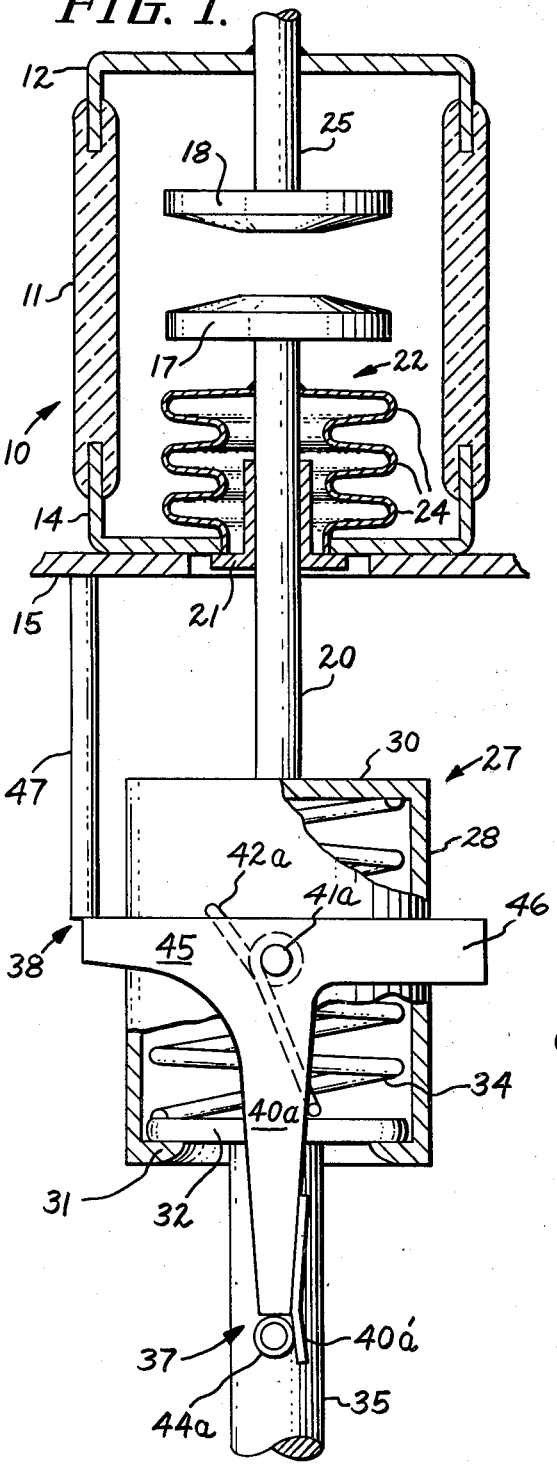
FIG. 1 is a plan view, partially in cross-section, of a vacuum circuit breaker having a wipe means and, according to the present invention, having a means for selectively latching the wipe means shown in a latched position.

Within the envelope 10 are a movable or first contact 17 and a stationary or second contact 18. The movable contact 17 is attached to a coupling member 20 which extends into the envelope 10 and which is maintained in vertical, straight-line alignment by a suitable guide 21, slidably receiving the member 20 and secured to the lower end 14. With the contacts 17 and 18 abutting each other, as in FIG. 2, the movable contact 17 is in a closed position and can carry current. The movable contact 17 is in an open position when separated from the contact 18, as in FIG. 1. The movable contact 17 is in a fully open position, further separated from contact 18 than as shown in FIG. 1, during the steady state condition of the circuit breaker being "open".

A metal bellows 22 having three convolutions 24 provides a gas-tight seal between the coupling member 20 and the envelope 10. The bellows is typically formed from sheet stainless steel having a thickness of approximately three thousandths of an inch. The stationary contact 18 is attached to a conducting rod 25 which is secured in sealed relation to the upper end 12.

Figure 2:
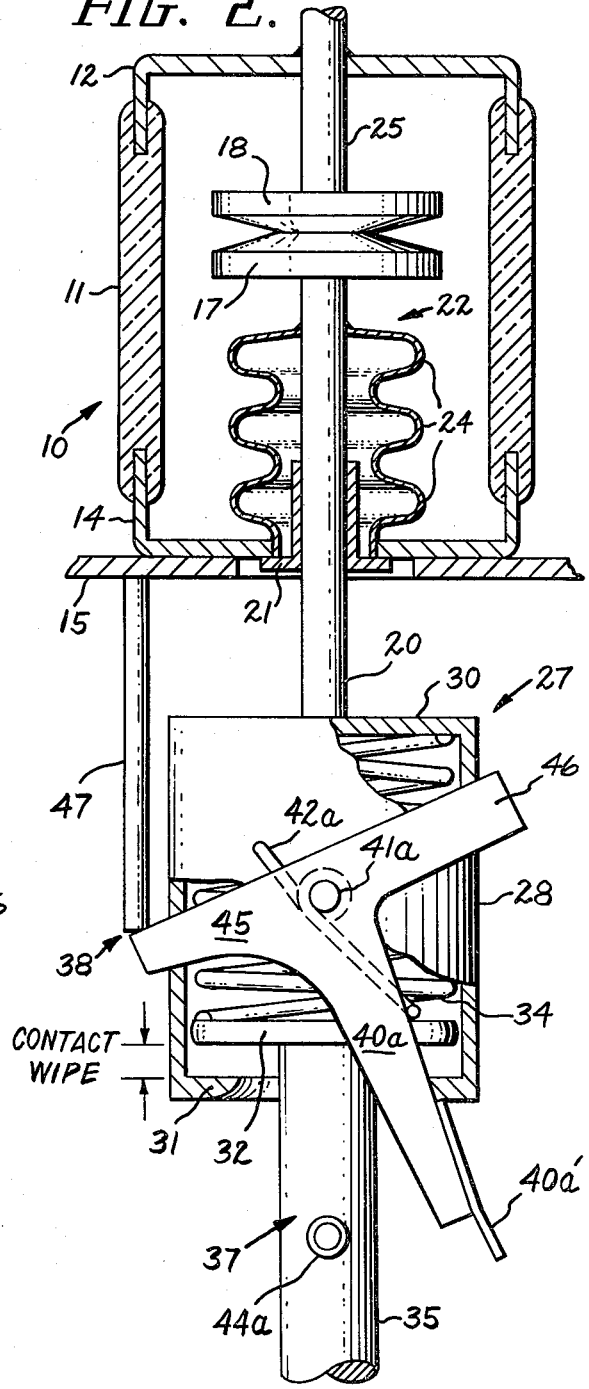
FIG. 2 is a view similar to FIG. 1 in which the means for selectively latching the wipe means is shown in an unlatched position.

The vacuum circuit breaker further includes a wipe cage or means 27 shown in a possible configuration thereof. The wipe means 27 comprises a hollow metal cylinder 28 having an upper end 30, and a lower, lipped end 31. The wipe means 27 further includes a disk 32 and a spring 34. The disk 32 is disposed within the cylinder 28 and the lower surface thereof is attached to an operating member 35 (discussed more fully hereinafter). The upper end of the spring 34, as viewed in FIG. 1 (or in FIG. 2 or 3 since each Figure is identically oriented), engages the lower surface of the upper end 30, and the lower end of the spring 34 engages the upper surface of the disk 32. The spring 34 serves to resiliently bias apart the upper end 30 and the disk 32. The lower, lipped end 31, in cooperation with the disk 32, serves to limit the maximum distance of separation between the end 30 and the disk 32. As is indicated in FIG. 2, when the contacts 17 and 18 are engaging each other, the disk 32 is raised relative to the lipped end 31 by a distance designated "CONTACT WIPE," the purpose of which is discussed above.

The operating member 35 is adapted to be connected to a mechanism (not shown) for moving the operating member 35 through an opening stroke in which the member 35 moves the movable contact 17 from the closed position to the fully open position, and through a closing stroke in which the member 35 moves the movable contact from the fully open position to the closed position.

The vacuum circuit breaker further includes a latch means 37 and a latch disabling means 38. The latch means 37 comprises symmetrical body members **40*a* and 40*b* (see FIG. 3), symmetrical pivots 41*a*, symmetrical torsion springs 42*a* and symmetrical stops 44*a* and 44*b*. The body members 40*a* and 40*b* are, respectively, connected rotatably by means of the respective pivots 41*a* to the cylinder 28. The lower ends of the torsion springs 42*a* each have a lower bent portion which abuts a respective righthand edge of the body members 40*a* and 40*b* as viewed in FIG. 3. The upper ends of the torsion springs 42*a* each have an upper bent portion suitably secured to a respective point on the cylinder 28. The torsion springs 42*a* are each looped around its respective pivot 41*a* (as shown in broken lines in FIG. 1 for spring 42*a*) whereby each spring 42*a* produces a clockwise torsion or torque on the respective body member 40*a* or 40*b* about the respective pivot 41*a*, as viewed in FIG. 1. The stops 44*a* and 44*b* vertically abut, respectively, the lower portion of the body members 40*a* and 40*b* and may advantageously comprise, as shown, a suitable roller carried on a respective supporting bar 44*a*' or 44*b*'. Extensions 40*a*' and 40*b*' together provide a limit to the clockwise rotation of the body members 40*a* and 40*b* when the extensions 40*a*' and 40*b*' abut, respectively, the stops 44*a* and 44*b***.

Figure 3:
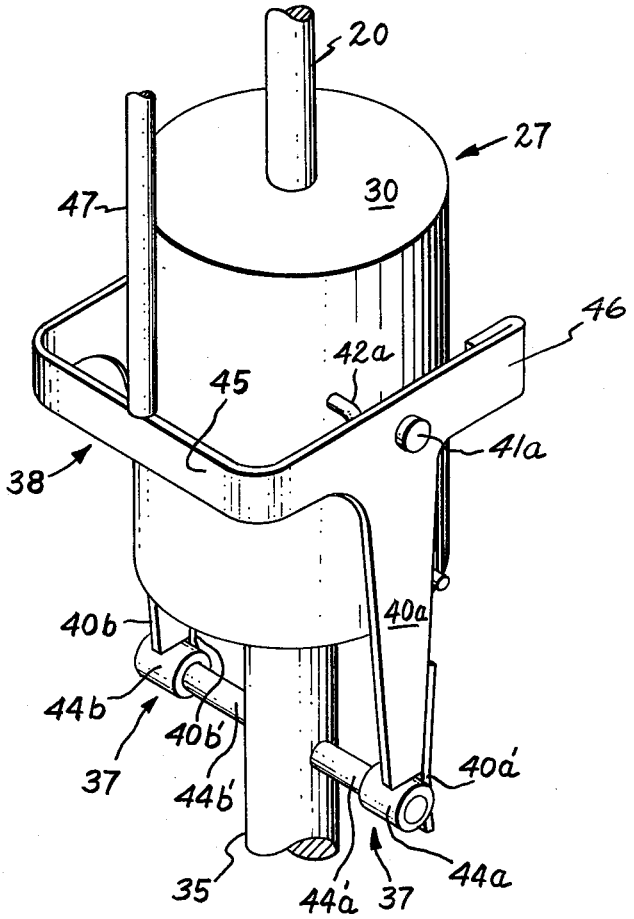
FIG. 3 is a perspective view illustrating details of the means for selectively latching the wipe means of the circuit breaker of FIG. 1. DETAILED DESCRIPTION Referring to FIG. 1, there is shown a vacuum circuit breaker including a sealed, evacuated envelope 10. The envelope 10 comprises a tubular casing 11 and ends 12 and 14 sealed to the upper and lower ends of the casing, respectively. The envelope 10 is suitably secured to a stationary support 15.

Referring particularly to FIG. 3, the latch disabling means 38 comprises an arm member 45, members 46, and a stop 47. The arm member 45 is rigidly connected to both body members **40*a* and 40*b*, and, thus, is rotably connected to both pivots 41*a*. The arm members 46 are likewise rigidly connected respectively to both body members 40*a* and 40*b*. The arm members 46 serve to counterbalance the arm member 45. The stop 47 is secured to the envelope support 15 and is positioned to abut the arm member 45 as the arm member 45** moves upward.

With the movable contact 17 initially in the closed position (FIG. 2), the operation of the latch means 37 and the latch disabling means 38 during the opening stroke of the operating member 35 is now described. With the contact 17 in the closed position, the wipe means 27 provides a certain amount of contact wipe as indicated in FIG. 2. However, further contact wipe can be provided by the wipe means 27 up to the point where the wipe means disk 32 has pressed the lower end of the wipe means spring 34 upward in the wipe means cylinder 28 until the spring 34 has fully contracted. To initiate separation of the contacts 17 and 18, the operating member 35 commences an opening stroke when it is moved downward by a mechanism (not shown). The operating member 35 initially travels the distance of the illustrated contact wipe prior to the transmission of movement of the member 35 to the contact 17 (through the wipe means 27). While the operating member 35 is initially travelling the contact wipe distance, the member 35 builds up considerable momentum, part of which is then transmitted to the contact 17 through the wipe means 27 whereby the contact 17 undergoes a desirable, rapid separation from the contact 18.

While the contact 17 is being separated from the contact 18, the latch means body members 40*a* and 40*b*, under the respective forces of torsion springs 42*a*, rotate clockwise as viewed in FIG. 2. This occurs because the pivots 41*a* move downward with respect to the stop 47 which, as shown in FIG. 2, impinges upon the arm member 45 in turn rigidly connected to the body members 40*a* and 40*b*. The body members 40*a* and 40*b*, continue to rotate clockwise and become aligned, respectively, over the stops 44*a* and 44*b*, or as shown in FIG. 1. Further clockwise rotation of the body members 40*a* and 40*b* is prevented by the respective engagements of the body member extensions 40*a'* and 40*b'* with the stops 44*a* and 44*b*. When the latch means 37 reaches the position shown in FIG. 1, it is rendered actuated, and, additionally, the latch disabling means 38 is rendered deactuated. It is desirable that the latch disabling means 38 become deactuated when the contact 17 is separated from the contact 18 but is substantially more proximate the closed position than the fully open position. This allows more time for the latch means 37 to become fully actuated during the opening stroke of the operating member 35, and, hence, relaxes the design requirements of the latch means 37. For example, the respective forces of the torsion springs 42*a* can thus be less than in the situation where the latch means 37 is allowed less time to become fully actuated.

When the latch means 37 is actuated it fixedly biases apart the wipe means end 30 from the wipe means disk 32 to substantially the maximum distance of separation therebetween. The following objectives are thereby attained during the opening stroke of the operating member:

(1) minimization of relative motion between the contact 17 and the operating member 35 after the member 35 initially imparts part of its considerable momentum to the contact 17 whereby there is provided a desirable, more controlled separation of the contacts 17 and 18;

(2) substantial elimination of contraction of the wipe means spring 34 and the accompanying overtravel and rebounding of the contact 17, and, hence also of the bellows 22, which can occur when the operating member 35 undergoes severe deceleration near the end of the opening stroke; and (3) elimination of the impact of the contact 17 against the operating member 35 with the attendant, particularly high stress generated in the bellows 24, which impact would occur if the wipe means spring 34 were allowed to fully contract under severe deceleration near the end of the opening stroke.

With the movable contact 17 initially in the fully open position, the operation of the latch means 37 and the latch disabling means 38 during the closing stroke of the operating member 35 is now described. With the contact 17 in the fully open position, the latch means 37 is actuated and the latch disabling means 38 is deactuated, the contact 17 and the wipe means 27 being somewhat lower than as shown in FIG. 1. The operating member 35 is initially caused to accelerate upwardly from the rest by a mechanism (not shown). Accordingly, the arm member 45 of the latch disabling means 38 moves upwardy from rest by a mechanism (not shown). Accordingly, the arm member 45 of the latch disabling means 38 moves upwardly and into abutment with the stop 47, the positions of the member 35 and the arm member 45 being as shown in FIG. 1. While the operating member 35 travels further upward, the arm member 45 is caused to rotate counterclockwise about the pivots 41*a*, and when the lower portions of the body members 40*a* and 40*a* no longer directly abut, respectively, the stops 44*a* and 44*b*, the latch means 37 becomes deactuated and the latch disabling means 38 becomes actuated. The operating member 35 continues to move upward after the contact 17 is in the closed position through a distance equaling the "CONTACT WIPE," as shown in FIG. 2.

During the closing stroke of the operating member 35, it is desirable that the latch disabling means 38 becomes actuated when the contact 17 is still separated from the contact 18 and is substantially more proximate the closed position than the fully open position. This is so in order to minimize the following problem. After the latch disabling means 38 becomes actuated (and the latch means 37 becomes deactuated), and wipe means spring 34 can contract under the acceleration caused by the operating member 35. If the spring 34 has so contracted and is then expanding as the contact 17 approaches and abuts the contact 18, the velocity of the contact 17 will have a component due to shch expanding of the spring 34. If the contact 17 is allowed to impact the contact 18 with a sufficiently high velocity, the contact 17 will bounce away from the contact 18 one or more times with the risk of severe erosion and welding of the contacts 17 and 18.

While the invention has been described in relation to a specific embodiment, modifications of the invention will occur to those skilled in the art. For example, the latch means 37 could be modified to become actuated in response to acceleration of the operating member 34 during the opening stroke thereof. Similarly, the latch disabling means 38 could be modified to become actuated in response to the deceleration of the operating member 35 during the closing stroke thereof. These and all such modifications are deemed to fall within the spirit and scope of the invention as defined in the appended claims unless expressly defined otherwise.

What I claim as my invention and desire to be secured by Letters Patent of the United States is:

1. A vacuum circuit breaker comprising:

(a) a sealed, evacuated envelope;

(b) first and second separable, electrical contacts contained in said envelope, said first contact being movable with respect to said second contact from a closed position when abutting said second contact and carrying normal current to a fully open position when separated from said second contact and not carrying current;

(c) wipe means having first and second ends, means for resiliently biasing apart said ends, and means to limit the maximum distance of separation between said ends, said wipe means providing contact wipe when said first contact is in said closed position;

(d) means for coupling said first contact to said wipe means first end, said coupling means extending into said envelope;

(e) bellows means for providing a gas-tight seal between said coupling means and said envelope;

(f) an operating member coupled to said wipe means second end, for moving said contacts from said closed position to said fully open position during an opening stroke thereof and for moving said contacts from said fully open position to said closed position during a closing stroke thereof;

(g) latch means rendered actuated during said opening stroke of said operating member for fixedly biasing apart said wipe means ends to a distance equaling said maximum distance of separation reduced by a distance substantially less than the maximum attainable contact wipe; and (h) latch disabling means rendered actuated during said closing stroke of said operating member for disabling said latch means.

2. The invention defined in claim 1 wherein said operating member causes contraction of said means for resiliently biasing apart said wipe means ends during said opening stroke.

3. The invention defined in claim 1 wherein said operating member causes contraction of said means for resiliently biasing apart said wipe means ends during said closing stroke.

4. The invention defined in claim 2 or 3 wherein said latch means fixedly biased apart said wipe means ends to substantially said maximum distance of separation.

5. The invention defined in claim 4 wherein said bellows means comprises sheet metal approximately three thousands of an inch thick.

6. The invention defined in claim 5 wherein said metal is stainless steel.

7. The invention defined in claim 2 or 3 wherein said latch disabling means is rendered deactuated during said opening stroke when said first contact is separated from said second contact but is substantially more proximate said closed position than said fully open position.

8. The invention defined in claim 2 or 3 wherein said latch disabling means is rendered actuated during said closing stroke when said first contact is still separated from said second contact and is substantially more proximate said closed position than said fully open position.

9. The invention defined in claim 1 wherein said latch means comprises:

(a) a body member rotably connected in fixed relation to said wipe means first end;

(b ) first stop means connected in fixed relation to said wipe means second end; and (c) means for resiliently biasing said body member into engagement with said first stop means.

10. The invention defined in claim 9 wherein said latch disabling means comprises:

(a) an arm member connected to said body member; and (b) second stop means connected in fixed relation to said envelope for abutting said arm member and rotating said body member out of engagement with said first stop means during said closing stroke of said operating member.

11. The invention defined in claim 1 wherein said wipe means comprises a cylinder, a disk slidably disposed in said cylinder, and a spring disposed in said cylinder said cylinder having closed and open ends, said open end having a lipped portion extending radially inward from said cylinder, said spring being disposed between and resiliently biasing apart said closed end and said disk, and said lipped portion and said disk cooperatively serving to limit the maximum distance of separation between said closed end and said disk.

* * * * *